United States Patent [19]

Bohannon, Jr. et al.

[11] Patent Number: 4,477,298

[45] Date of Patent: Oct. 16, 1984

[54] CABLE SHIELDING METHOD AND APPARATUS

[75] Inventors: William D. Bohannon, Jr.; Michael D. Kinard, both of Lawrenceville; Randy G. Schneider, Norcross, all of Ga.

[73] Assignee: AT&T Technologies, Inc., New York, N.Y.

[21] Appl. No.: 423,405

[22] Filed: Sep. 24, 1982

Related U.S. Application Data

[63] Continuation of Ser. No. 257,671, Apr. 24, 1981, abandoned.

[51] Int. Cl.[3] ..... H01B 13/26

[52] U.S. Cl. ..... 156/54; 156/203; 156/466; 156/578; 174/102 C; 174/102 D; 228/148

[58] Field of Search ..... 156/52, 54, 203, 466, 156/578; 174/102 C, 102 D, 102 R; 228/130, 150, 148

[56] References Cited

U.S. PATENT DOCUMENTS

| | | | |
|---|---|---|---|
| 3,530,018 | 9/1970 | Ash | 156/54 |
| 3,534,149 | 10/1970 | Peacock et al. | 174/105 R |
| 3,575,748 | 4/1971 | Polizzano | 156/54 |
| 3,785,048 | 1/1974 | Petersen | 174/105 R X |
| 3,944,459 | 3/1976 | Skobel | 156/461 |
| 4,035,211 | 7/1977 | Bill et al. | 156/54 |
| 4,221,926 | 9/1980 | Schneider | 156/54 X |
| 4,360,395 | 11/1982 | Suzuki | 156/54 |

*Primary Examiner*—Robert Dawson
*Attorney, Agent, or Firm*—E. W. Somers

[57] ABSTRACT

A cable shielding method and apparatus are disclosed wherein adhesive 42 is applied to a strip 40 of shielding material within a shield forming die 20 as the strip 40 is being formed about a cable core 10 with an overlapped shield seam.

4 Claims, 12 Drawing Figures

CABLE SHIELDING METHOD AND APPARATUS

This is a continuation of application Ser. No. 257,671, filed Apr. 24, 1981, now abandoned.

TECHNICAL FIELD

This invention relates to methods and apparatuses for forming sealed shields about telecommunication cable cores.

BACKGROUND OF THE INVENTION

Telecommunication cables are often comprised of a core that is overlayed with a metallic shield and an outer plastic jacket. The core itself is formed of a number of individually twisted insulated wire pairs or quads tightly bundled together and covered with a core wrap. The metallic shield is typically corrugated to provide cable flexibility and to protect the core from both mechanical and electrical damage. The plastic jacket, which is normally formed by extruding polyethylene onto the metallic shield, provides a moisture penetration barrier as well as additional mechanical protection for the core.

Recent cable configurations have employed a sealed, longitudinally split tubular shield having its longitudinal side portions overlapped to form a seam with adhesive bonding the two overlapped portions together. One such cable configuration is comprised of corrugated aluminum coated on each side with an ethylene acrylic acid copolymer. The overlapped seam portions of this type of shield are adhesively bonded together by the use of a hot melt or molten ethylene acrylic acid type adhesive.

One system for forming a sealed shield of the type just mentioned is disclosed in U.S. Pat. No. 4,035,211 which is assigned to the assignee of the present invention. Here, a cable core is passed through a belt former and overlap die partially overlayed with a strip or tape of corrugated aluminum. Within the belt former and die the copolymer coated aluminum shielding material is formed so as to encircle the cable core completely and to bring its opposite, longitudinal side portions into a configuration forming an overlapped seam. After exiting the belt former and die the shielded core is routed through a seam separator which reopens the seam. This is followed by passing the core and shield aside an extruder which applies adhesive onto one side portion of the now separated seam. Following this the shielded core is routed through two rollers which press the overlapped seam portions back together. Later, a polyethylene jacket is extruded onto the sealed shield.

Today some telecommunication cables, termed "Stalpeth cables", are being constructed for underground duct deployment which need to be shielded with metal offering higher strength than does aluminum or copper. Thus, their outer shields are formed of corrugated steel. The steel overlays rather than replaces the aluminum shield in order to retain electrical protection for the core. Again, the steel is preferably chemically bonded to a polyethylene jacket by the use of a layer of ethylene acrylic acid copolymer to provide buckling and moisture diffusion resistance. However, since steel is much less ductile than aluminum or copper, it possesses a very substantial degree of spring back. Thus, where it has been formed into a tubular configuration about a cable core with an overlapped seam, it has been difficult to reopen and to spread the seam apart in order to apply the adhesive. Accordingly, there exists a need today for a method and apparatus for providing a sealed shield about a cable core that overcomes the just described problems. It is to this task to which the present invention is primarily directed.

SUMMARY OF THE INVENTION

In one form of the invention a method is provided for shielding a cable core which comprises the steps of introducing the core and a strip of shielding material into a shield forming die with the strip positioned partially about the core. Opposed longitudinal side portions of the strip are brought into a position of mutual adjacency and one strip side portion then coated with adhesive. The strip is then brought into a position with the other side portion overlaying the adhesively coated one side portion and the core and strip then advanced out of the shield forming die.

In another form of the invention a method is provided for shielding a cable core wherein a strip of shielding material is wrapped about a cable core in a shield forming die. Adhesive is applied to a surface of one side portion of the strip located distal the core within the die prior to overlaying that surface with the laterally opposite side portion of the tape.

In still another form of the invention apparatus is provided for forming a sealed shield about a cable core. The apparatus comprises a die having interior wall means configured to transform a strip of cable shielding material passing through the die at least partially about a cable core passing through the die into a greater than full cable core encirclement shape with one longitudinal side portion of the strip covered by the opposite longitudinal side portion of the strip. The apparatus further comprises means for introducing adhesive into the die and onto the one longitudinal side portion of the strip prior to its being covered by the other side portion of the strip by the die interior wall means.

In yet another form of the invention a die is provided for forming a sealed shield about a cable core. The die has a generally truncated conically shaped interior wall provided with a longitudinal slot along a portion thereof in which slot nozzle means are mounted for introducing adhesive into the die and onto a strip of shielding material being advanced through the die interior wall.

DETAILED DESCRIPTION

Figure 1:
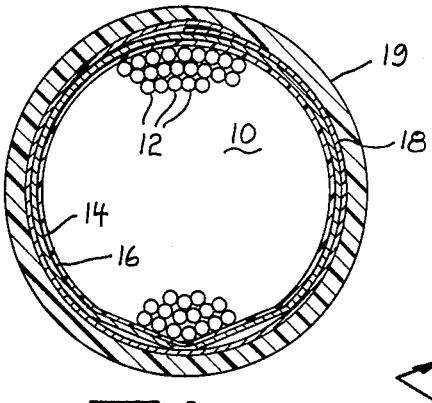
FIG. 1 is a cross-sectional view of a portion of a telecommunications cable showing the cable core and sheath.

Referring now in more detail to the drawing there is shown in FIG. 1 a telecommunications cable having a shield core sheath that comprises a sealed shield formed about the core in accordance with principles of the present invention. The cable is seen to include a core 10 formed of a number of twisted insulated wire pairs 12 overlaid with a core-wrap 14. An aluminum shield 16 is formed about the core-wrap and is in turn overlayed with a sealed steel shield 18. Finally, a polyethylene jacket 19 is extruded about the steel sheath 18 to form an outer jacket.

Figure 2:
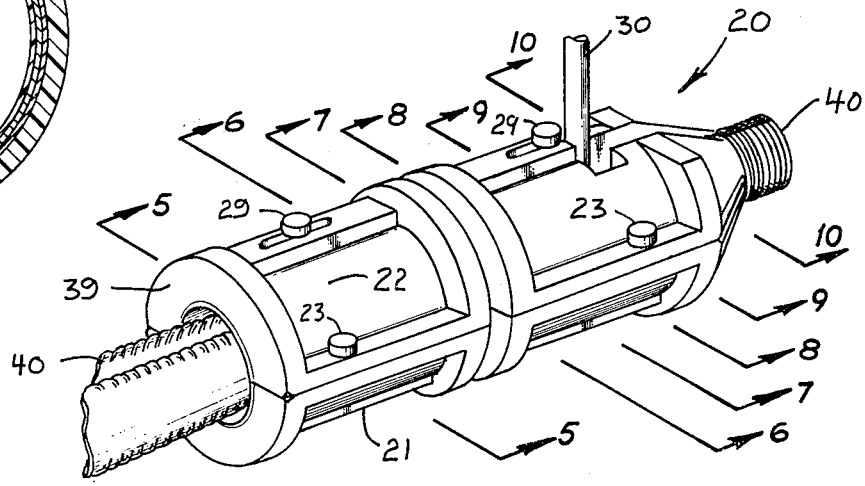
FIG. 2 is a perspective view of apparatus for forming a sealed shield about a cable core in accordance with principles of the present invention.
Figure 3:
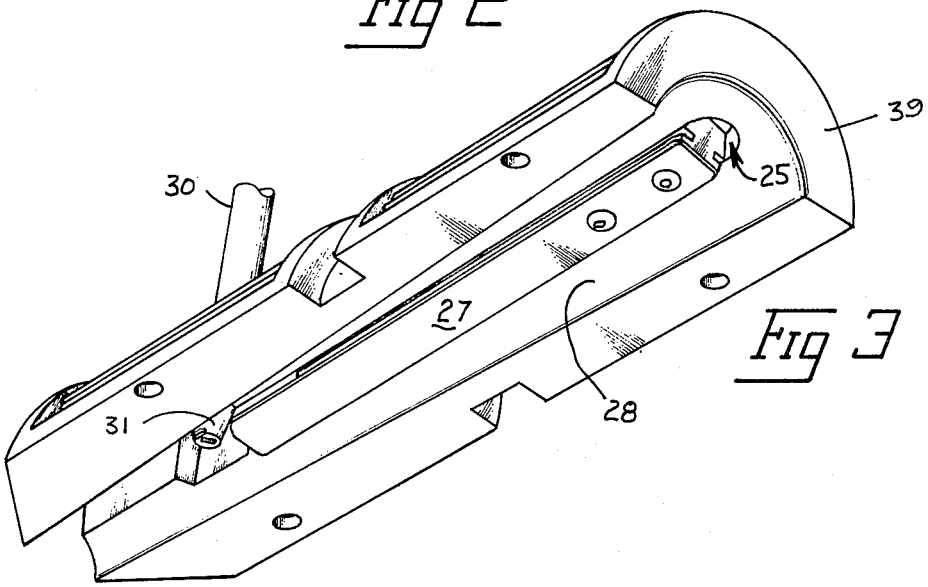
FIG. 3 is a perspective view of the upper half of the apparatus illustrated in FIG. 2.
Figure 4:
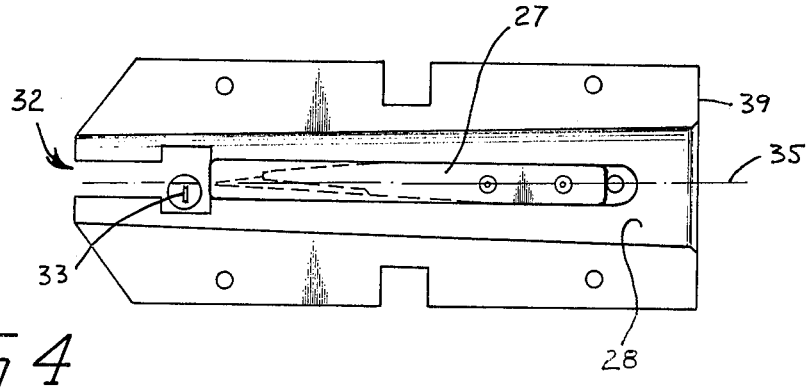
FIG. 4 is a bottom view of the apparatus illustrated in FIG. 3.

In FIGS. 2–4 apparatus is shown for forming the steel shield 18 about the cable core which is seen to include a shield forming die 20 having two half-cylindrical portions 21 and 22 secured together by bolts 23. The upper section 22 is seen to be provided with a longitudinal slot 25 in which a shield edge forming guide or key 27 is mounted by means of bolts 29. A lower portion of this key extends downwardly into a cavity within the die that is defined by a generally truncated conically shaped interior wall 28. This wall is provided by the combined two die section 21 and 22 and tapers inwardly from the die end 39. A conduit 30 is mounted to the die with a nozzle end 31 located down within a generally slot-shaped opening 32 in die section 22 just downline from the key 27 to position a nozzle orifice 33 adjacent an end of the key 27. The conduit 30 is in fluid communication with a supply of adhesive. The conduit nozzle is preferably located above the longitudinal axis 35 of the die at a position at which the die internal wall 28 has tapered inwardly sufficient as to have caused a strip of corrugated shielding material 40 to have fully encircled the cable core passing therethrough.

Figure 5:
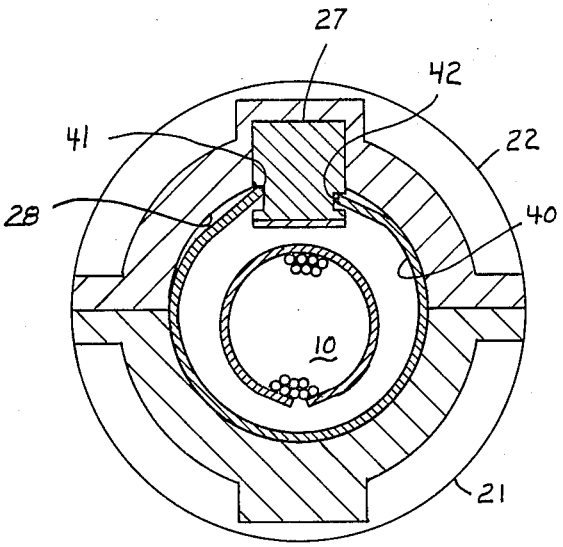
FIGS. 5–10 provide a sequence of transverse cross-sectional views taken planes 5—5 through 10—10 of the apparatus shown in FIG. 2.
Figure 6:
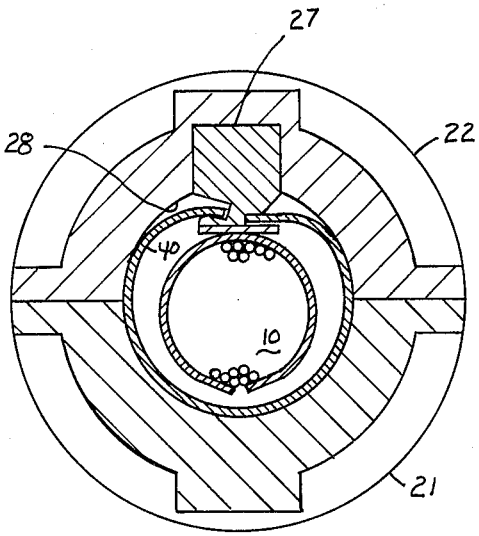
Figure 7:
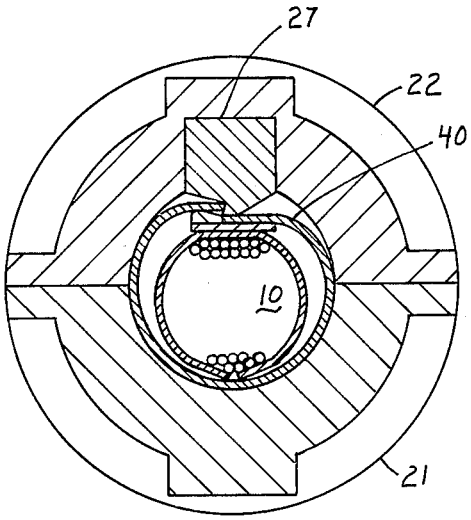
Figure 8:
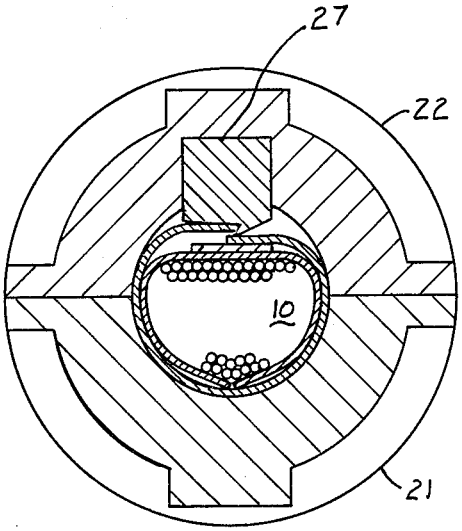
Figure 9:
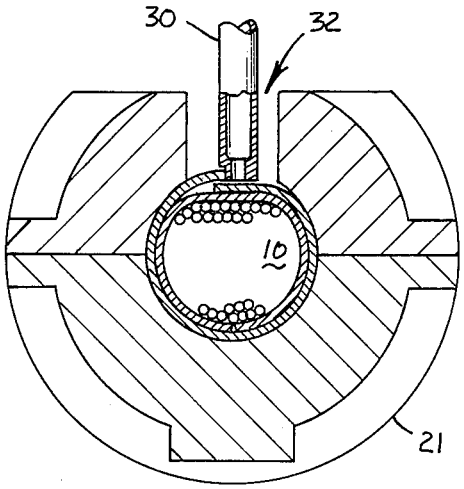
Figure 10:
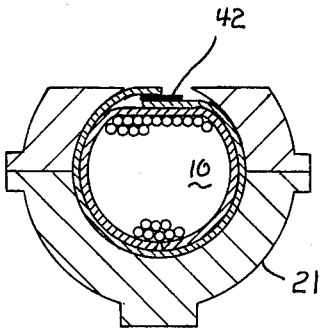
Figure 12:
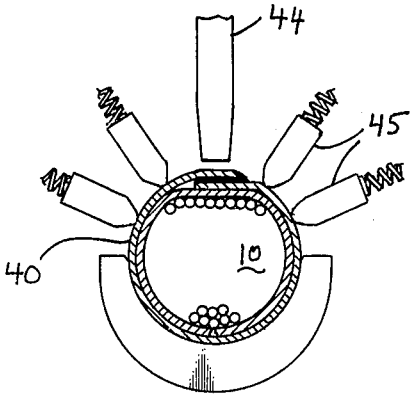
FIG. 12 is a cross-sectional view of the cooling station for the cable downline from the apparatus illustrated in FIG. 2.
Figure 11:
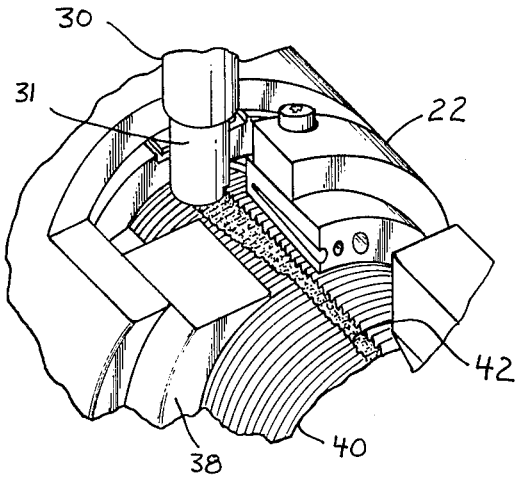
FIG. 11 is a perspective view of an end portion of the apparatus illustrated in FIG. 2 showing a ribbon of adhesive being applied to a cable shield.

With reference next to FIGS. 5 through 12 the method in which the apparatus just described may be used in practicing the invention is now described. In FIG. 5 the corrugated metal strip 40 entering the die end 39 is seen to be positioned about the cable core 10 with strip edges 41 and 42 located within lateral slots of the key 27. As the shield and core progress on through the die the shield encounters the continuously converging conical interior wall 28 which, in combination with the deeping configuration of the lateral key slots, causes the longitudinally opposed side edges of the steel shield to wrap further about the cable core. During this travel the overlapping corrugations of the strip tend to mate with ridges of one side being guided into the troughs of the other side. By the time the shield has progressed down to plane 9, as shown in corresponding FIG. 9, a longitudinal side portion of the shield adjacent the shield edges has reached an overlapped configuration. As the shield moves under the nozzle 31 here, as also shown in FIG. 11, adhesive flows out of the nozzle orifice 33 and onto a surface of one side portion of the strip of material 40 located distal the core 10. As further seen here, the other side portion of the strip slightly overlays but is also spaced slightly above that surface of the side edge portion covered with the adhesive. As the cable core and shield move further downline from the nozzle, as also shown in FIG. 11, the still converging conical interior walls of the die 20 cause the strip side portions to assume a more overlapped configuration. As this is done some of the now coated side portion of the strip is overlayed with the strip opposite side portion. During this time compressive force is applied by the die wall to the overlapped portions of the strip and to the adhesive therebetween.

As the steel strip and core leave the die end 38 the shield has assumed the configuration shown in FIG. 10 with a portion of the adhesive ribbon 42 sandwiched between opposite side portion of the strip while another portion of the ribbon faces ambient air. Following this the core and shield are routed beneath an air cooler 44 with hastens setting of the adhesive. During this time spring biased holddown bars 45 ensure that the shield configuration is maintained. With the adhesive now set the spring back force of the steel is well overcome by the adhesive seal.

It thus is seen that a method and apparatus of forming a sealed shield about a cable core is provided. It should be understood, however, that the just described embodiments illustrate principles of the invention of preferred forms. Many modifications, additions and deletions may, of course, be made thereto without departure from the spirit and scope of the invention as set forth in the following claims.

What is claimed is:

1. A method of shielding a cable core comprising the steps of:

(a) introducing the core and a strip of corrugated metallic shielding material into a shield forming die with the strip positioned at least partially about the core;

(b) bringing opposed longitudinal side portions of the corrugated strip into a position of mutual adjacency with one side portion of the strip partially overlaid by the other side portion and with their corrugations substantially aligned;

(c) coating the one side portion along a portion thereof which is not overlaid by the other side portion with adhesive;

(d) bringing the strip into a position with the other side portion overlaying and pressed against the adhesive coated one side portion; and (e) advancing the core and strip out of the shield forming die.

2. A method of shielding a cable core in accordance with claim 1, wherein during steps (b), (c) and (d) the other side portion of the strip of material is continually being wrapped further over the one side portion of the strip.

3. Apparatus for forming a sealed metallic shield about a cable core comprising a die having interior wall means for transforming a strip of cable shielding material passing through the die at least partially about a cable core passing through the die into a greater than full cable core encirclement shape with one longitudinal side portion of the strip covered by the opposite longitudinal side portion of the strip; and means for introducing adhesive into said die and onto the one longitudinal side portion of the strip after formed into a greater than full encirclement shape but prior to its being covered by the other side portion of the strip by said interior wall means and which includes a nozzle having an orifice located downline from that portion of said die wall means at which the strip of cable shielding material is initially transformed into the greater than full cable core encirclement shape.

4. Cable shield forming apparatus in accordance with claim 3 wherein said die interior wall means comprises a generally conically shaped wall along a longitudinal portion of which a strip edge forming key extends, and wherein said adhesive introduction means is mounted to said die adjacent an end of said edge forming key.

* * * * *